US005598615A

United States Patent [19]

Takada

[11] Patent Number: 5,598,615

[45] Date of Patent: Feb. 4, 1997

[54] SILK VELVET TEXTILE AND METHOD OF MANUFACTURING THE SAME

[75] Inventor: Tooru Takada, Nerima-ku, Japan

[73] Assignee: K. K. Age, Tokyo, Japan

[21] Appl. No.: 534,649

[22] Filed: Sep. 27, 1995

[30] Foreign Application Priority Data

Jul. 7, 1995 [JP] Japan ..... 7 -194005

[51] Int. Cl.[6] ..... D06C 11/00; D06C 13/00; D06C 23/02; D06M 11/00

[52] U.S. Cl. ..... 28/159; 28/167; 8/128.1

[58] Field of Search ..... 28/159, 167; 8/128.1, 8/128.2

[56] References Cited

U.S. PATENT DOCUMENTS

| | | | |
|---|---|---|---|
| 574,401 | 1/1897 | Depoully et al. | 8/128.1 X |
| 2,238,098 | 4/1941 | Bradshaw | 28/159 X |
| 2,574,029 | 11/1951 | Foster | 28/167 X |
| 2,656,585 | 10/1953 | Jackson | 28/167 X |
| 2,705,880 | 4/1955 | Kinzinger et al. | 28/159 X |
| 3,017,847 | 1/1962 | Keen | 28/159 |
| 3,173,189 | 3/1965 | Lacy | 28/167 |
| 3,293,723 | 12/1966 | Evans | 28/159 |
| 3,694,873 | 10/1972 | Crowley | 28/159 X |
| 3,925,865 | 12/1975 | Christian | 28/167 X |

FOREIGN PATENT DOCUMENTS

| | | | |
|---|---|---|---|
| 765290 | 10/1971 | Belgium | 28/159 |
| 7014670 | 4/1987 | Japan | 28/159 |
| 951142 | 3/1964 | United Kingdom | 28/159 |

OTHER PUBLICATIONS

Effects of Organic Solvents Used in Drycleaning on Silk, M. Hagiwara, (Shinshu Univ –Nagano)Journal of Sericultural Science of Japan, 62, No. 5: 412–419, Oct. 1993.

*Primary Examiner*—John J. Calvert

*Attorney, Agent, or Firm*—Armstrong, Westerman, Hattori, McLeland & Naughton

[57] ABSTRACT

The invention relates to a silk velvet textile and the method of manufacturing the same. Spun silk or pure silk is worked on an ordinary pile loom or knitting machine to produce a silk textile having the luster, touch or texture characteristic of silk so that such textile can be used for wide variety of velvet goods to meet the consumers' needs for upmarket products. Spun silk or pure silk is subjected to a twisting process to be followed by a pasting process or steaming process for 10 to 20 minutes before feeding said spun silk or pure silk is worked on by an ordinary pile loom or knitting machine. The texture such as fabric or jersey is dipped in lukewarm water for a predetermined period of time to remove paste for the texture to shirink such that the shrinking texture ground fastens the piles.

15 Claims, 1 Drawing Sheet

SILK VELVET TEXTILE AND METHOD OF MANUFACTURING THE SAME

BACKGROUND

The present invention relates to a silk velvet fabric or jersey made of pure silk or spun silk.

Conventionally, a pile knitting machine is used for producing a pile or velvet fabric or jersery out of cotton, wool, synthetic fiber or rayon which are widely used for apparels, towels, bed sheets, bed covers, hats, ornaments for rooms, linings for shoes or gloves, all sorts of decorations, etc, Taking into consideration the excellent touch of velvet fabric, attempts have been made in addition to the above mentioned applications to manufacture velvet textile materials out of raw silk in place of quilt feathers by use of a pile looms or a pile knitting machines. However, the surface of pure silk or spun silk intended for use is so slippery that the piles of said pure silk or spun silk tend to come off the textile ground, thus making it impossible to use pure silk or spun silk.

SUMMARY OF THE INVENTION

It is therefore the object of the present invention to provide silk velvet fabric or jersey which can be used for the development of various silk products promising softest feel and excellent touch never experienced in the conventional silk products and a method of manufacturing the same.

In one aspect, the present invention accomplishes the above mentioned object by means of a silk velvet textile comprising a textile ground; and a plurality of piles extending from at least one side of said textile ground, said pile and said textile ground being subjected to shrinkage treatment to such an extent that said piles are fastened by said textile ground.

In another aspect, the present invention accomplishes the above mentioned object also by means of a method of manufacturing a silk velvet textile comprising the steps of twisting silk threads, imparting a viscosity to said silk threads, weaving or knitting said silk threads to prepare a silk velvet textile having a textile ground and pile extending from at least one side of said textile ground, and dipping said silk velvet textile into a lukewarm water to define and cause said textile ground to shrink to such an extent that said textile ground portion fastens said piles.

DETAILED DESCRIPTION OF THE EMBODIMENTS

Figure 1:
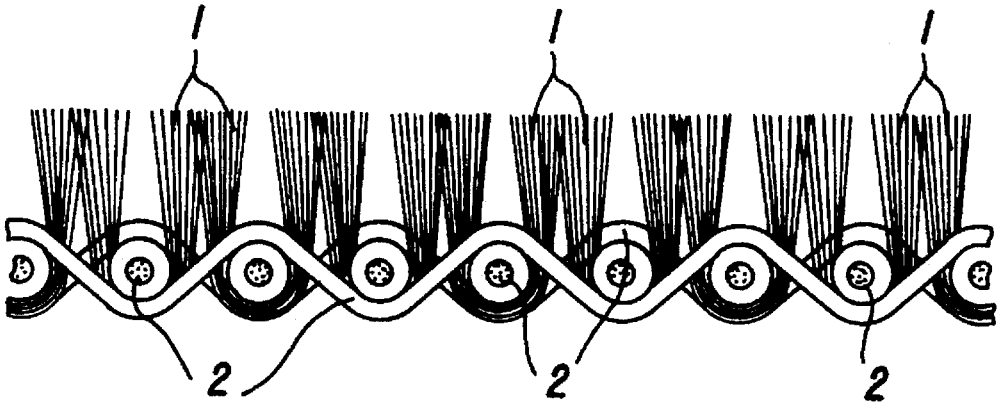
FIG. 1 is a sectional view of the silk velvet fabric composed of cut piles and a ground portion of the silk velvet fabric.

Next, silk velvet fabric or silk velvet jersey and the method of manufacturing the same will be outlined hereinafter. First, sericin is removed from raw silk by the known method. Thereafter, pure-silk yarns are each prepared by joining together plural pieces of fibroin. Otherwise spun silk yarns may be prepared by the known method. Such pure silk yarns or spun silk yarns are provided in the form of threads for preparing piles and the textile ground. Said threads for the fabric or jersey are twisted such that said yarns are subject to shringkage in a subsequent treatment thereof.

After said twisting step, the threads are imparted with viscosity before subjecting said threads to a knitting operation by a pile knitting machine to prepare jersey. Said jersey is dipped into a lukewarm water having a temperature between 50 to 85 degrees centigrade for a period of 2 to 5 hours to refine said jersey and is dried while the jersey is caused to shrink such that not only velvety texture is obtained but cut piles are fastened by the shrinking jersey ground to prevent said cut piles from falling off the textile ground. For a drying purpose, a softening agent may be added before performing a finishing operation with a tumbler drier to further improve the texture.

A method of manufacturing silk velvet jersey will be explained hereinafter. Roughly speaking, yarns and threads are needed for two purposes; that is, ones for piles and the others for the jersey ground. In order to prepare a required size for each two spun silk threads for making piles are prepared each by intertwining three No. 80 spun silk twin yarn threads while one No. 80 spun silk twin yarn is used for making the textile ground of the jersey.

Said intertwined three No. 80 twin yarn threads are presented as a spun silk thread. Two such spun silk threads are joined into a piece of spun silk for forming piles while one No. 80 twin yarn is used, as is, for forming the ground portion of jersey.

A piece of such spun silk for piles is given a twist of 600 to 800 turns per meter, preferably 600 turns per meter, while a piece of spun silk for the jersey ground is given a twist of 600 to 800 turns, preferably 600 turns per meter, before pieces of such spun silk are caused to go through a paste of 5 parts of water to 1 part of a fiber-use surface active agent dissolved therein at a normal temperature. The concentration of the paste may be selected from the range of 1 part against 4 to 7 parts of water.

Said pieces of spun silk are worked on by the known knitting machine to produce a silk velvet jersey composed of a textile ground and a number of piles extending from one side of said textile ground. Said silk velvet jersey is in a condition in which the pieces of the spun silk are kept extended due to the tension given during the knitting operation with the paste being applied thereon. Said paste is removed by dipping said silk velvet jersey into a hot water of 70 degrees centigrade for three hours such that the pieces of spun silk are restored to the original condition and dried. As a result, the width of the jersey shrinks from 140 cm to 114 cm to provide a contraction of 18.57% laterally, making the stitch closer and giving an excellent texture.

The thus manufactured jersey is, as shown in FIG. 1, caused to shrink to such an extent that cut piles 1 are fastened by the sufficiently shrinking textile ground of the spun silk to prevent said cut piles from falling off. In this connection, it is to be noted that spaces are depicted for the facility of drafting in the figure between the silk pieces though such spaces are non-existant since the textile ground is caused to shrink and tighten up such that the piles as mentioned above are fastened thereby.

Therefore, it is needless to say that it is necessary to prepare a sheet of jersey of 170 cm wide in advance in order to eventually obtain a standard width of 140 cm. After obtaining the jersey, the four hems are given a finishing knitting. A jersey thus completed may be used, as is, for bed sheets or pillow covers while two pieces of such jersey may be joined together to provide a blanket.

While spun silk is used both for the piles and the textile ground in the aforementioned example, pure silk may be used both for the piles and the textile ground. In this case, 30 pieces of 28 denier pure silk each are joined together to produce a 840 denier thread which in turn is given a twist of 600 to 800 turns per meter and preferably 600 turns per meter. On the other hand, 5 pieces of 28 denier pure silk are joined together 5 yarns to provide a 140 denier thread which in turn is given a twist of 1000 to 1800 turns per meter, preferably 1,400 turns per meter.

The thus prepared pure silk is made to go through a paste as described in the foregoing embodiment or through a steam of boiling hot water for 10 to 20 minutes. Said pure silk is worked on by a knitting machine to provide a silk velvet jersey which is further refined by being dipped in a hot water of 70 degrees centigrade for three hours. As a result, the jersey of originally obtained 140 cm width is cause to shrink down to 100 cm; that is, 196 cm width of jersey sheet is required to obtain a standard size of 140 cm. The twisted ground portion threads tend to regain the original state, making the fabric puffier than immediately after the knitting operation.

It is also possible to use pure silk for the piles and spun silk for the ground portion. In this case, a piece of pure silk is prepared by joining together 30 threads of 28 denier into a 840 denier thread as in the foregoing to be given a twist of 600 to 800 turns per meter, preferably 600 turns per meter. On the other hand, No. 80 twin yarns of the spun silk for the textile ground are respectively given a twist of 1000 to 1600 turns/m, preferably 1400 turns/m. The thus obtained pure silk and spun silk are made to go through paste or a steam of boiling water for 10 to 20 minutes. Said pure silk and spun silk are dipped into a hot water of 70 degrees centigrade for three hours such that the pure silk and spun silk are reduced to the original condition and dried. As a result, the jersey of 140 cm wide similarly shrinks down to 100 cm wide; that is, 196 cm width of jersey is required to obtain a standard size of 140 cm.

While the known pile knitting machines are shown to be used for knitting jersey of pure silk and spun silk in the afore-mentioned embodiments, it is not limited to the knitting machine and a known pile loom may be used for producing a silk velvet fabric.

As detailed in the foregoing cut piles and the textile ground of the silk velvet jersey are subjected to a shrinkage process. Therefore, the ground portion tightens up to fasten the piles to keep from falling off with the result that apparels or other textile products manufactured from silk velvet textile has come into existance.

Further, the retention of piles are effectively realized by a relatively large frictional resistance of spun silk by using spun silks for piles and the textile ground in the present invention.

Further, the sense of high quality silk products can be enjoyed by using pure silks both for the piles and the textile ground.

Further, the use of pure silk for the piles and spun silk for the textile ground permits the maximum use of the high quility feel of the pure silk as well as the pile retaining power of the spun silk, thus making it possible to produce the ideal textile products.

Further, the method of manufacturing said silk velvet jersey involves the formation of raw silk prepared through twisting threads, imparting viscosity to the twisted yarns and threads, and thereafter knitting a velvet jersey by means of a knitting machine with the result that piles in the jersey will not fall off, thus making it possible to use raw silk on the velvet knitting machine for materials other than silk. Further, pure silk or spun silk used as materials in the thus manufactured velvet textile are twisted such that the textile made of such materials is caused to shrink when dipped in a lukewarm water for refinement to such an extent that the cut piles is fastened by the textile ground and kept from falling off.

Further, the embodiment in which spun silk used both for the piles and the textile ground are lightely twisted 600 to 800 turns per meter has an advantage that the fabric or the jersey is caused to shrink sufficiently for the piles to keep from falling off.

Further, the embodiment in which pure silk used both for the piles and the textile ground are tightly twisted 1000 to 1600 turns per meter has an advantage that the textile ground is caused to shrink sufficiently for the piles to keep from falling off.

Further, the embodiment in which pure silk used both for the piles and the textile ground are tightly twisted 1000 to 1600 turns per meter has an advantage that the ground portion is caused to shrink sufficiently for the piles effectively to be fastened thereby and keep from falling off. Further, the embodiment in which the yarns and threads for the piles and the textile ground are imparted with viscosity by being caused to go through a paste solution permits a loom or a knitting machine effectively works on the yarns and threads.

Further, the embodiment in which the the yarns and threads for the piles and the textile ground are imparted with viscosity by being subjected to the steam of boiling water permits the threads to become tenderer than those going through paste such that the yarns and threads are easily caught by the knitting machine, thus making the knitting operation smoother.

Further, the embodiment in which the textile is dipped in lukewarm water of 50 to 85 degrees centigrade permits the ground of the fabric or the jersey to sufficiently shrinks for the piles to be retained while commercialization of the high quality silk velvet fabric or jersey is realized.

In this way, the invention has made unprecedented products of 100% silk velvet-fabric or jersey existant. Moreover, such products, while being 100% of silk material, are subjected to a shrinkage process to the maximum degree so that consumers can wash the products with water or lukewarm water. Therefore, silk materials can also be used for towels, bed sheets, bed covers, hats, ornaments for rooms, lining for shoes or gloves which are conventionally made of cotton, wool, synthetic fiber rayon with the result that product development planning finds its way in a wide range of fields, thus making it possible to enjoy a rich consumer life.

What is claimed is:

1. A silk velvet textile comprising:

a textile ground consisting essentially of natural silk; and a plurality of piles consisting essentially of natural silk, wherein said plurality of piles extend from at least one side of said textile ground, said plurality of piles and said textile ground being fastened together due to shrinkage treatment.

2. The silk velvet textile according to claim 1, wherein said piles and said textile ground are prepared of spun silk.

3. The silk velvet textile as in claim 2, wherein said spun silk for said piles is formed by joining two spun silk threads, each of said two spun silk threads having been formed by intertwining three No. 80 spun silk twin yam threads and giving said spun silk a twist of 600 to 800 turns per meter.

4. The silk velvet textile as in claim 3, wherein said spun silk for said ground is formed of one spun silk thread that has been formed by intertwining three No. 80 spun silk twin yarn threads and giving said spun silk a twist of 600 to 800 turns per meter.

5. The silk velvet textile as in claim 4, wherein said spun silk is subjected to a paste having a concentration ranging from four to seven parts of water to one part of a fiber-use surface active agent dissolved therein at a normal temperature.

6. The silk velvet textile according to claim 1, wherein said piles and said textile ground are prepared of pure silk.

7. The silk velvet textile as in claim 6, wherein said pure silk for said piles is formed by joining 30 pieces of 28 denier pure silk to form a 840 denier pure silk thread which is given a twist of 600 to 800 turns per meter.

8. The silk velvet textile as in claim 7, wherein said pure silk for said ground is formed by joining five pieces of 28 denier pure silk to provide a 140 denier pure silk thread which is given a twist of 1,000 to 1,400 turns per meter.

9. The silk velvet textile as in claim 8, wherein said pure silk is subjected to a paste having a concentration ranging from four to seven parts of water to one part of a fiber-use surface active agent dissolved therein at a normal temperature.

10. The silk velvet textile as in claim 8, wherein said pure silk is subjected to steam of boiling hot water for between 10 to 20 minutes.

11. The silk velvet textile according to claim 1, wherein said piles are prepared of pure silk while said textile ground is prepared of spun silk.

12. The silk velvet textile as in claim 11, wherein said pure silk for said piles is formed by joining 30 pieces of 28 denier pure silk to form a 840 denier pure silk thread which is given a twist of 600 to 800 turns per meter.

13. The silk velvet textile as in claim 12, wherein said spun silk for said ground is formed of one spun silk thread that has been formed by intertwining three No. 80 spun silk twin yarn threads and giving said spun silk a twist of 1,000 to 1,400 turns per meter.

14. The silk velvet textile as in claim 13, wherein both said spun silk and said pure silk are subjected to a paste having a concentration ranging from four to seven parts of water to one part of a fiber-use surface active agent dissolved therein at a normal temperature.

15. The silk velvet textile as in claim 13, wherein both said spun silk and said pure silk are subjected to steam of boiling hot water for between 10 to 20 minutes.

* * * * *